US007828943B2

(12) United States Patent
Coltri

(10) Patent No.: US 7,828,943 B2
(45) Date of Patent: Nov. 9, 2010

(54) ANODE FOR AN APPARATUS FOR THE GALVANIC COATING OF THE RUNNING SURFACES OF CYLINDERS

(75) Inventor: Carlo Coltri, Rivoltella del Garda (IT)

(73) Assignee: Aerotecnica Coltri S.p.A., Rivoltella Del Garda (BS) (IT)

( * ) Notice: Subject to any disclaimer, the term of this patent is extended or adjusted under 35 U.S.C. 154(b) by 580 days.

(21) Appl. No.: 11/816,592

(22) PCT Filed: Feb. 21, 2005

(86) PCT No.: PCT/IT2005/000091

§ 371 (c)(1),
(2), (4) Date: Feb. 8, 2008

(87) PCT Pub. No.: WO2006/087743

PCT Pub. Date: Aug. 24, 2006

(65) Prior Publication Data

US 2008/0264782 A1 Oct. 30, 2008

(51) Int. Cl.
*C25B 11/03* (2006.01)

(52) U.S. Cl. ..... 204/284; 204/280

(58) Field of Classification Search ..... 204/280, 204/284

See application file for complete search history.

(56) References Cited

U.S. PATENT DOCUMENTS 2,706,175 A 4/1955 Licharz
4,280,884 A * 7/1981 Babb et al. ..... 205/566
4,645,580 A * 2/1987 Paulet et al. ..... 204/272
5,126,638 A * 6/1992 Dethlefsen ..... 315/326
5,552,026 A 9/1996 Ikegaya et al.
5,645,641 A 7/1997 Maier
6,033,548 A * 3/2000 Akram et al. ..... 205/143
6,086,731 A * 7/2000 Ishigami et al. ..... 204/224 R
6,135,053 A * 10/2000 Okamura ..... 118/723 E
6,662,034 B2 * 12/2003 Segner et al. ..... 600/373
6,724,146 B2 * 4/2004 Small ..... 315/39.77
2003/0205960 A1 * 11/2003 Small ..... 313/325

OTHER PUBLICATIONS

Patent Abstracts of Japan vol. 1 2000, No. 04, Aug. 31, 2000 & JP 2000 008191 A (Honda Motor Co. LTD), Jan. 11, 2000 Abstract; Figures 3-6.

Database WPI Section Ch, WEek 198137 Derwent Publications Ltd., London, GB; XP002354340 & SU 791 791 A (Tolstenko Pavel P, SU), Dec. 30, 1980 Abstract; Figure 1.

* cited by examiner

*Primary Examiner*—Bruce F Bell
(74) *Attorney, Agent, or Firm*—Volpe and Koenig, P.C.

(57) ABSTRACT

A hollow anode for a galvanic coating apparatus of the running surfaces of cylinders is provided with a plurality of passages in its top portion. The total area of the passages reduces the surface of the anode by at least 50%, the top portion having a height between 4 and 12 mm. Thus, a decrease in the electrical field at the top of the cylinder is achieved without affecting the deposition in the rest of the cylinder and it is therefore possible to obtain a perfect coating up to the corners of a closed cylinder, while decreasing the deposition on the vault of the combustion chamber. Furthermore, it is also possible to increase the flow rate of the electrolyte through the apparatus thus decreasing coating time and exploiting a greater hydraulic pressure of the electrolyte, which provides a mechanical effect that favors deposition, especially at the corners.

7 Claims, 1 Drawing Sheet

ANODE FOR AN APPARATUS FOR THE GALVANIC COATING OF THE RUNNING SURFACES OF CYLINDERS

FIELD OF INVENTION

The present invention relates to apparatuses for the galvanic coating and/or pre-treating of the running surfaces of cylinders, and in particular to an anode to be used in such an apparatus.

BACKGROUND

It is known that the running surfaces of cylinders of internal combustion engines, pumps and the like are coated with layers of materials particularly resistant to corrosion, wear, etc. These coatings are typically obtained through galvanic deposition with apparatuses known in the field, such as for example those disclosed in U.S. Pat. No. 5,552,026 or U.S. Pat. No. 5,645,641.

In brief, in said apparatuses there is used an electrolyte fed inside the cylinders through piping and drained from the cylinders through a central duct that acts as anode, the cathode being connected to the cylinder block. In order to obtain a proper coating on the whole height of the cylinder, the anode usually reaches the top of the cylinder or close thereto, so that the electrolyte fills the cylinder prior to flowing out through the hollow anode.

This type of apparatus works properly, although with some drawbacks, for open cylinders, i.e. those with the head separate from the cylinder body. On the contrary, a significant difficulty arises in the case of closed cylinders, i.e. those with the head integral with the cylinder body, since it would be necessary to decrease the electrical field at the top of the cylinder. This is a problem in that merely decreasing the intensity of the current circulating between anode and cathode would imply a decrease in the electrical field along the whole height of the cylinder, which would result in an insufficient deposition on the rest of the internal surface of the cylinder.

Said decrease at the top is necessary to be able to obtain a proper coating up to the corner between the side wall and the head of the cylinder, and also to minimize the deposition of the coating on the vault of the combustion chamber formed in the cylinder head.

In fact, due to the Faraday cage effects caused by the geometry of the top of a closed cylinder, the same electrical field that in the rest of the cylinder guarantees a good deposition, at the corners turns out to be too strong for a proper deposition. Moreover, the deposition on the vault of the combustion chamber is to be avoided because said surface, in use, reaches temperatures so high as to damage the coating that can break off and fall into the cylinder causing damage.

In the case of open cylinders, that are generally flared at the top, the intense electrical field causes an excessive build-up of coating material at the sharp edges of the flaring. As a consequence, the cylinder may require an additional working to remove said build-up, or a previous working to radius the flaring in order to eliminate the sharp edges.

Therefore the object of the present invention is to provide an anode which overcomes the above-mentioned drawbacks. This object is achieved by means of an anode whose top portion has a plurality of passages that imply a reduction in surface by at least 50%, which results in a corresponding decrease in the electrical field. Other advantageous features of the present anode are disclosed in the dependent claims.

SUMMARY

The main advantage of the present anode is that of achieving the desired decrease in the electrical field at the top of the cylinder without affecting the deposition in the rest of the cylinder, hi this way, it is possible to obtain a perfect coating up to the corners of the closed cylinder, while decreasing the deposition on the vault of the combustion chamber. Similarly, in the application to open cylinders the build-up at the sharp edges is reduced, thus dispensing with a further working prior to or after the coating treatment.

A second significant advantage of this anode is that of allowing an increase in the flow rate of the electrolyte, since the passages in the top portion increase the area of the outflow cross-section. As a consequence, it is possible to decrease the coating time and to exploit also a greater hydraulic pressure of the electrolyte, which provides a mechanical effect that favors the deposition, especially at the corners.

BRIEF DESCRIPTION OF THE DRAWING

These and other advantages and characteristics of the anode according to the present invention will be clear to those skilled in the art from the following detailed description of an embodiment thereof with reference to the only drawing, annexed as FIG. 1, that shows a vertical sectional view of the upper part of a closed cylinder in which an anode according to the present invention is arranged.

DETAILED DESCRIPTION OF THE PREFERRED EMBODIMENTS

Figure 1:
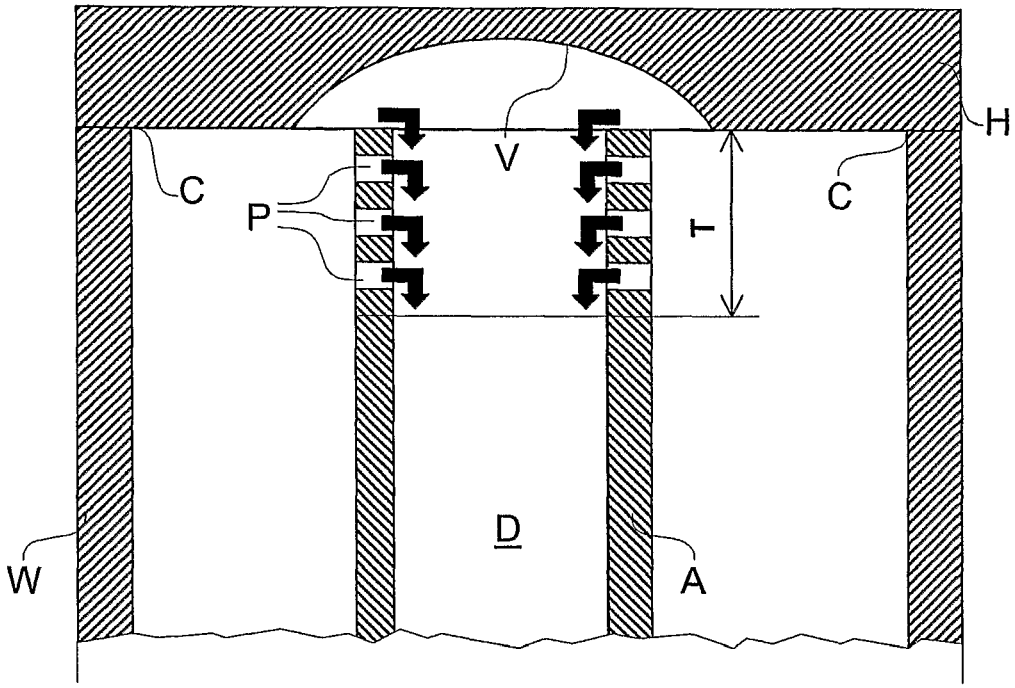

With reference to said FIGURE there is illustrated a closed cylinder in which the cylinder head H is integral with the side wall W and forms a corner C therebetween. In the center of the cylinder there is arranged a hollow anode A, whose inner cavity D acts as a drain duct for the electrolyte fed into the cylinder through piping not shown.

The novel aspect of the present invention is given by the provision of a plurality of passages P formed in the top portion T of anode A. The total area of passages P is such as to achieve at least a 50% reduction in the surface of anode A at the top portion T, preferably between 70% and 80%, the height of said top portion T being between 4 and 12 mm.

The shape and arrangement of passages P will change according to the specific coating requirements, i.e. passages P can have any shape (round, square, elongated, etc.) and they can be arranged in aligned rows, in staggered rows, in a random pattern and so on.

As explained above, the surface reduction achieved by means of passages P implies a decrease in the electrical field at the top of the cylinder and allows to obtain a proper deposition of the galvanic coating at corner C, while preventing the deposition of the coating on the vault V of the combustion chamber.

Furthermore, the outflow of the electrolyte occurs not only through the top opening of anode A (the two arrows at the top), but also through passages P as indicated by the other six arrows.

To form passages P in the top portion T it is possible to drill holes in a common anode, but portion T is preferably an additional element that is welded at the top of the anode. In this way it is easy to manufacture anodes with different percentages of surface reduction and different geometries of passages P, preferably using for portion T a net ring or a grid ring with different mesh sizes.

It is clear that the above-described and illustrated embodiment of the anode according to the invention is just an example susceptible of various modifications.

In particular, the exact shape and size of anode A, of the top portion T and of passages P can be changed according to the specific treatment requirements, as long as the above-mentioned dimensional parameters remain within the indicated ranges.

The invention claimed is:

1. Hollow anode comprising a plurality of passages formed in a top portion thereof, the total area of said passages being such as to achieve at least a 50% reduction in the surface of the anode at said top portion, the height of said top portion being between 4 and 12 mm.

2. Hollow anode according to claim 1, wherein the total area of the passages is such as to achieve a surface reduction between 70% and 80%.

3. Hollow anode according to claim 1, wherein the top portion comprises an additional element welded at the top of the anode.

4. Hollow anode according to claim 3, wherein the top portion comprises a net ring or a grid ring.

5. Hollow anode according to claim 1, wherein the passages are formed by drilling holes in the top portion of a common anode.

6. Hollow anode according to claim 2, wherein the top portion comprises an additional element welded at the top of the anode.

7. Hollow anode according to claim 2 wherein the passages are formed by drilling holes in the top portion of a common anode.

* * * * *